US010599074B2

(12) United States Patent
Driggers

(10) Patent No.: US 10,599,074 B2
(45) **Date of Patent: *Mar. 24, 2020**

(54) DRIVE BELT SYSTEMS INCLUDING BELT STRETCH MANAGEMENT APPARATUS AND METHODS THEREOF

(71) Applicant: HEWLETT-PACKARD DEVELOPMENT COMPANY, L.P., Houston, TX (US)

(72) Inventor: Matt G. Driggers, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 337 days.

This patent is subject to a terminal disclaimer.

(21) Appl. No.: 15/641,989

(22) Filed: Jul. 5, 2017

(65) Prior Publication Data

US 2017/0299986 A1 Oct. 19, 2017

Related U.S. Application Data

(63) Continuation of application No. 13/162,331, filed on Jun. 16, 2011, now Pat. No. 9,715,194.

(51) Int. Cl.
*G03G 15/16* (2006.01)

(52) U.S. Cl.
CPC ..... *G03G 15/1615* (2013.01); *G03G 2215/00143* (2013.01)

(58) Field of Classification Search
CPC ..... G03G 15/1615; G03G 2215/00143
See application file for complete search history.

(56) References Cited

U.S. PATENT DOCUMENTS

| | | | | |
|---|---|---|---|---|
| 3,811,332 | A * | 5/1974 | Brown | F16H 7/08 474/111 |
| 4,145,934 | A | 3/1979 | Sragal | |
| 4,487,518 | A | 12/1984 | Enrini | |
| 4,746,237 | A | 5/1988 | Takeda | |
| 4,869,707 | A * | 9/1989 | in 't Zandt | G03G 15/263 474/115 |
| 5,232,407 | A | 8/1993 | Wolf et al. | |
| 5,902,201 | A * | 5/1999 | Vermeer | F16H 7/24 474/109 |
| 6,244,765 | B1 | 6/2001 | Harriman et al. | |
| 6,439,454 | B1 | 8/2002 | Masson et al. | |
| 6,690,494 | B1 | 2/2004 | Yamada | |
| 6,960,145 | B2 * | 11/2005 | Fraley, Jr. | B62D 5/0424 180/444 |

(Continued)

*Primary Examiner* — Michael R Mansen
*Assistant Examiner* — Juan J Campos, Jr.
(74) *Attorney, Agent, or Firm* — HP Inc. Patent Department

(57) ABSTRACT

Drive belt systems and methods thereof are disclosed. Drive belt systems and methods thereof include driving a continuous belt around a drive pulley member and an idler pulley member by the drive pulley member and transporting a transport unit and/or reciprocating carriage unit coupled to the continuous belt in a first direction away from the drive pulley member. Drive belt systems and methods thereof also include applying at least a force to the belt in a traverse direction thereto to direct a portion of the belt about the drive pulley member by a belt stretch management apparatus coupled to the transport unit and/or reciprocating carriage unit.

20 Claims, 8 Drawing Sheets

(56) References Cited

U.S. PATENT DOCUMENTS

| | | | | |
|---|---|---|---|---|
| 7,758,460 | B2 | 7/2010 | Osakabe et al. | |
| 8,223,351 | B2 | 7/2012 | Eun et al. | |
| 8,295,736 | B2 | 10/2012 | Funamoto et al. | |
| 9,715,194 | B2 * | 7/2017 | Driggers | G03G 15/1615 |
| 2008/0170884 | A1 | 7/2008 | Matsuda | |
| 2010/0271453 | A1 | 10/2010 | Toya | |

* cited by examiner

DRIVE BELT SYSTEMS INCLUDING BELT STRETCH MANAGEMENT APPARATUS AND METHODS THEREOF

CROSS-REFERENCE TO RELATED APPLICATIONS

This application is a Continuation Application of U.S. application Ser. No. 13/162,331, filed Jun. 16, 2011, which is incorporated herein by reference.

BACKGROUND

Drive belt systems move a belt about pulley members to transport a transport unit attached to the belt. The transport unit may include a reciprocating carriage unit to hold a printhead. Periodically, the belt may stretch and enter a slack state such that a slack loop may form in the belt and a wrap angle of the belt about a pulley member may decrease.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1A:
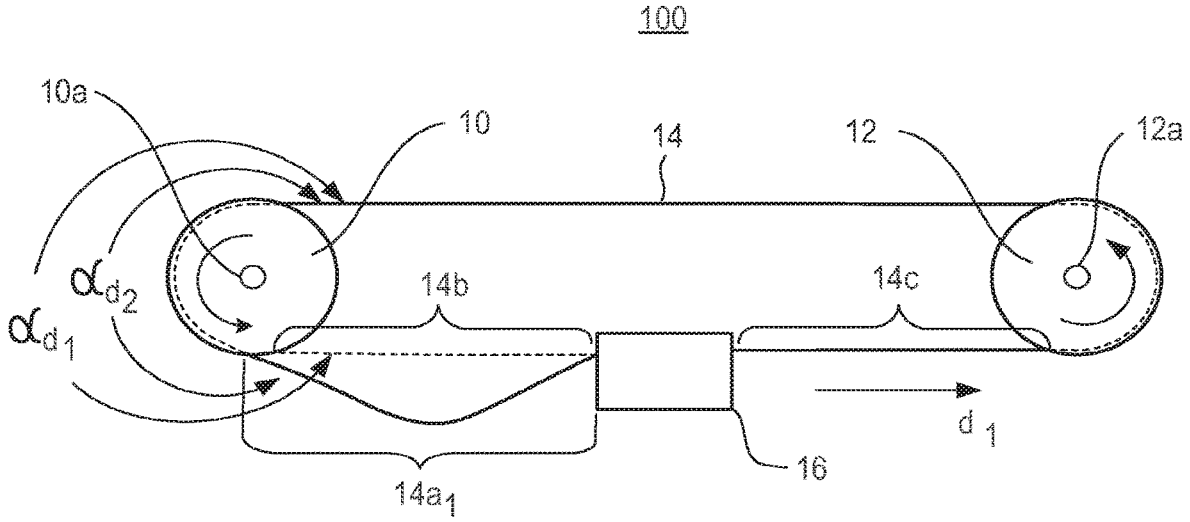
FIGS. 1A and 1B are schematic views illustrating a drive belt system in a slack state without a belt stretch management apparatus thereof according to examples.

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Drive belt systems move a belt about pulley members to transport a transport unit attached to the belt. The transport unit may include a reciprocating carriage unit to hold a printhead. Periodically, under drive loads the belt may stretch and enter a slack state such that a slack loop may form in the belt and a wrap angle of the belt about a pulley member may decrease. A slack state may also be due to an effective increase in belt length, for example, by flexing of structure such as pulley members supporting the belt and a bending of a cantilevered drive motor shaft under load. Thus, a center-to-center spacing between the respective pulley members is decreased.

Belt stretch is an effective increase to a length of a belt due to an application of forces and/or a reduction of a distance between respective pulley members. The slack state of the belt, for example, due to belt stretch gives rise to a decrease in a respective belt wrap angle. The decrease in the respective belt wrap angle reduces an amount of force a drive belt system can transmit and/or support. If such a force is less than a force being applied by a driving element such as a drive motor, skipping and/or slippage of the belt may occur. Consequently, inadequate management of belt stretch may lead to unwanted slippage and/or skipping of the belt on the respective pulley member.

Some belt tension devices may increase tension forces to address increased weight loads of the transport unit in a loaded state. Such increased tension forces, however, may contribute to system motor failures and use of expensive motors and drive electronics. Some spring-loaded rollers may address unwanted belt slippage and skipping. Such spring-loaded rollers, however, may increase cost and maintenance due to an increase amount of moving components. Accordingly, a cost-effective and low maintenance solution to manage belt stretch to reduce a potential for a drive belt system to enter a slack state resulting in belt skipping and slippage is desired.

In examples, the drive belt system includes, among other things, a belt stretch management apparatus coupled to a transport unit. The belt stretch management apparatus applies at least a first force to a belt in a traverse direction thereto to direct a portion of the belt about a drive pulley member. The first force directs the portion of the belt around the drive pulley member in response to formation of belt stretch corresponding to transportation of a transport unit along with the belt stretch management apparatus in the first direction. That is, the formation of belt stretch to a drive-side belt portion (e.g., portion of the belt between the transport unit and the drive pulley member) is managed by reducing a potential of a wrap angle about the drive pulley member to decrease due to belt stretch and the drive belt system to enter a slack state.

The belt stretch management apparatus may include a unitary spring member that applies minimal forces to the belt. Such minimal forces for example, maintain or increase the wrap angle about the respective pulley member when primary tension forces established by the respective pulley members are weakened in localized sections of the belt due to belt stretch. Such minimal forces generally do not interfere with the primary tension forces absent the presence of belt stretch. Consequently, the belt drive system provides a cost-effective and low maintenance solution to manage belt stretch to reduce a potential for a drive belt system to enter a slack state resulting in belt skipping and slippage. Additional slack may be created by an effective increase in a length of the belt due to a reduction of a center-to-center distance between the drive pulley member and the idler pulley member. Such a reduction in the distance between the respective pulley members may be due to structural deflections such a bending of a drive motor shaft, and the like (not illustrated).

Figure 1B:
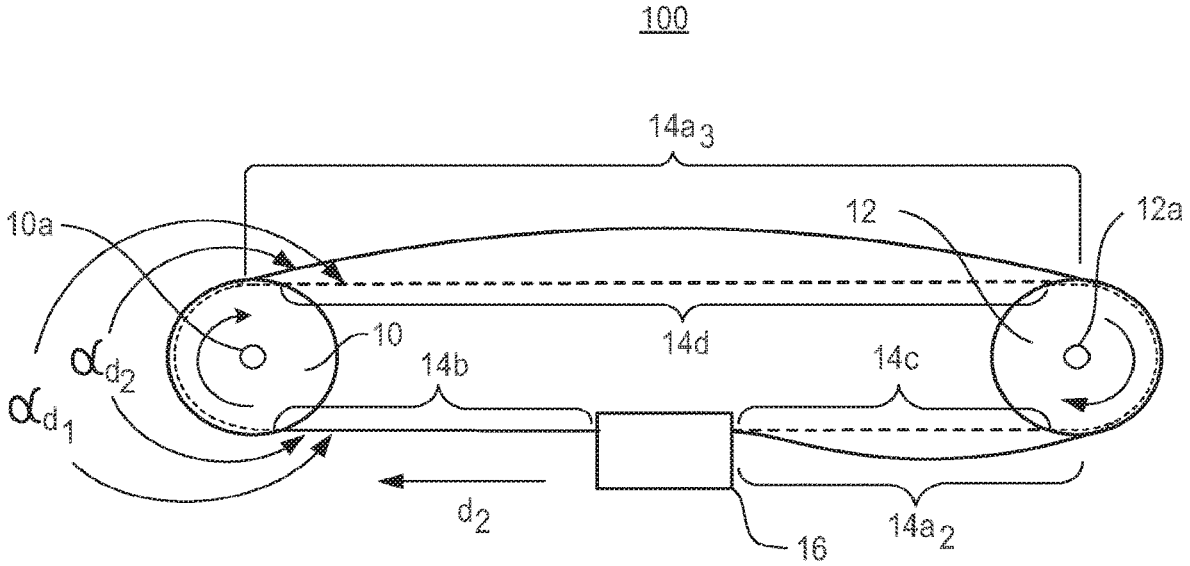

FIGS. 1A and 1B are schematic views illustrating a drive belt system in a slack state without a belt stretch management apparatus thereof according to examples. Referring to FIGS. 1A and 1B, a drive belt system 100 includes a drive pulley member 10 having a drive axis 10*a*, an idler pulley member 12 having an idler axis 12*a*, a belt 14, and a transport unit 16. The idler pulley member 12 may be a fixed position idler pulley, a spring-loaded idler pulley, and the like. Referring to FIG. 1A, the belt 14 is moving the transport unit 16 in a first direction $d_1$. Referring to FIG. 1B, the belt 14 is moving the transport unit 16 in a second direction $d_2$. Periodically, the belt 14 may stretch, for example in response to belt stiffness, acceleration, and/or flexing caused by the transport unit 16 and enters a slack state due to inadequate management of belt stretch. In some examples, additional idler pulley members and/or drive pulley members may be used.

The slack state may correspond to a formation of slack loop 14$a_1$, 14$a_2$ and 14$a_3$ in the belt 14 resulting in a decrease in an amount of wrap angle of the belt 14 about a respective pulley member 10. That is, a wrap angle $\alpha_{d2}$ about the drive pulley member 10 after the formation of belt stretch is less than a wrap angle $\alpha_{d1}$ about the drive pulley member 10 before the formation of belt stretch. In some examples, the belt 14 may tend to stretch to form a slack loop 14$a_1$ on a drive-side belt portion 14*b* during movement of the belt 14 in the first direction $d_1$ as illustrated in FIG. 1A. In some examples, the belt 14 may tend to stretch to form a slack loop 14$a_2$ on an idler-side belt portion 14*c* and an extended belt portion 14*d* (e.g., a portion of the belt 14 disposed opposite the transport unit 16 and between the drive pulley member 10 and the idler pulley member 12) during movement of the belt 14 in the second direction $d_2$ as illustrated in FIG. 1B.

Such belt stretch may result in a portion of the drive-side belt portion 14*b* to move away from the drive pulley member 10 reducing an ability of the drive belt system to handle the provided torque. Thus, the lack of adequate management of belt stretch may lead to unwanted slippage and/or skipping of the belt 14 on the respective pulley member 10 due to the drive belt system 100 entering a slack state. Such slipping and/or skipping may degrade the respective pulley member 10, degrade the belt 14, stall the transportation of the transport unit 16, and/or emit objectionable noises.

Figure 2:
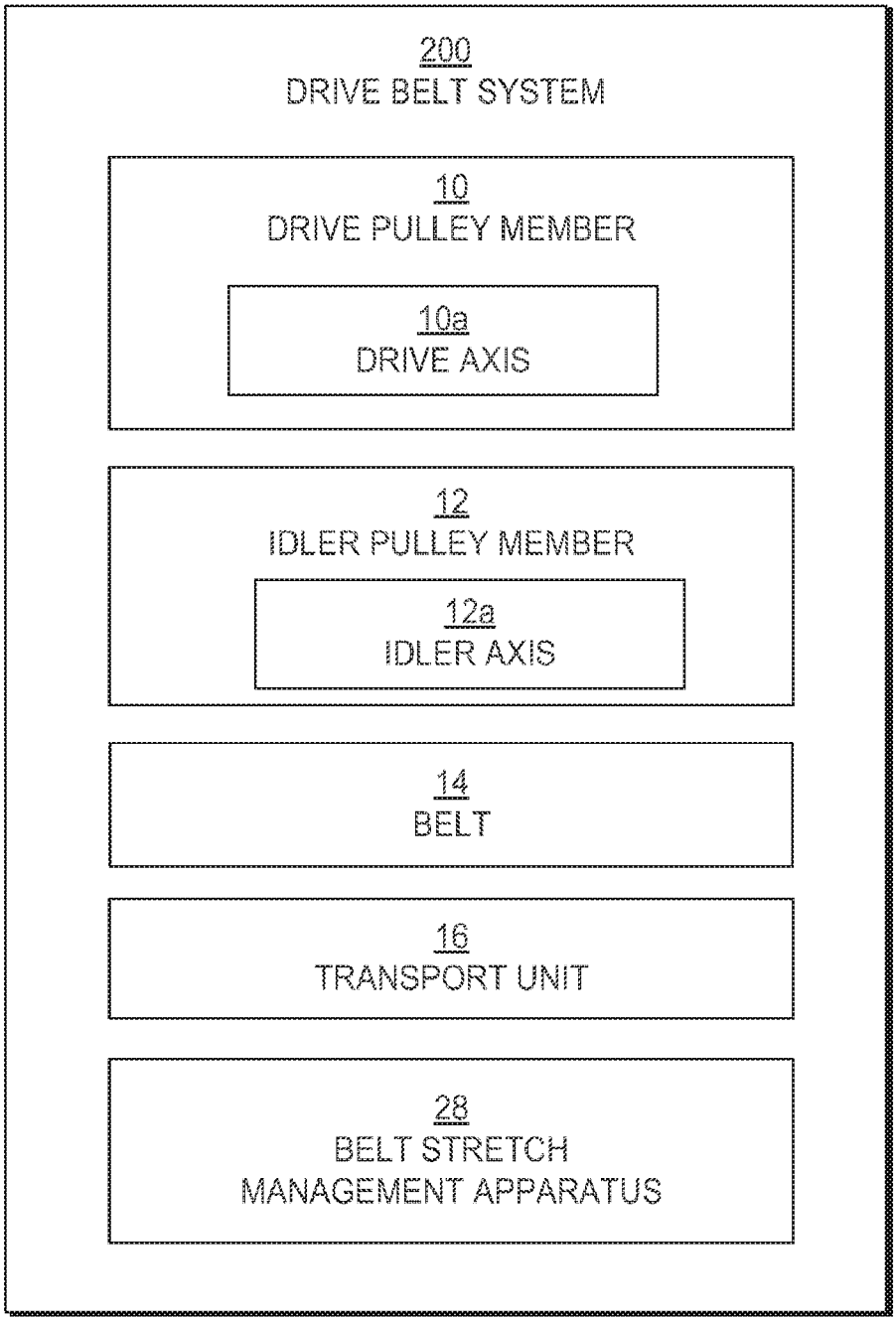
FIG. 2 is a block diagram illustrating a drive belt system according to an example.
Figure 3A:
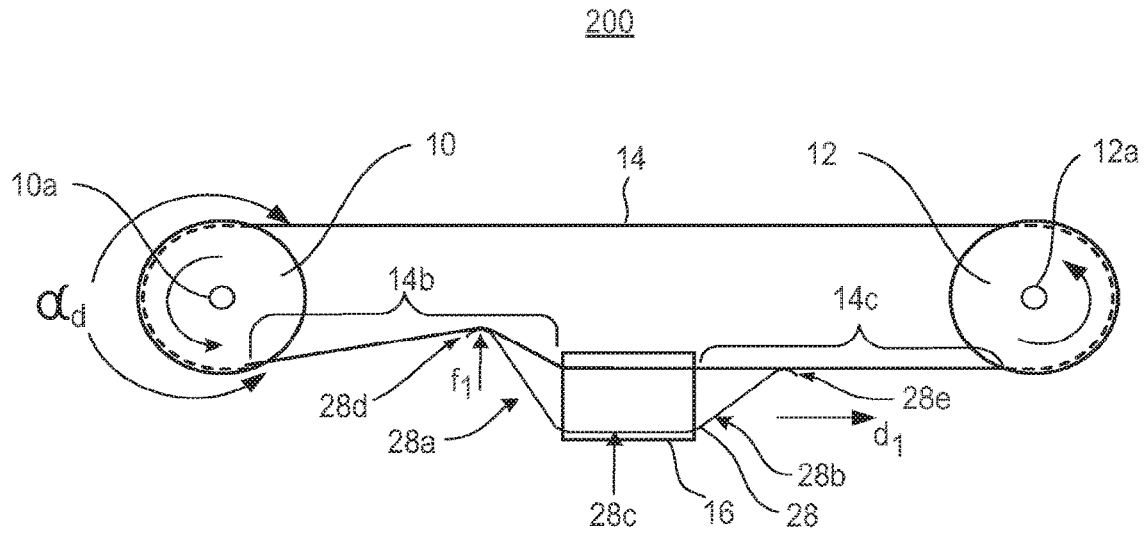
FIG. 3A is a schematic view illustrating the drive belt system of FIG. 2 in which a belt is moving in a first direction according to an example.
Figure 3B:
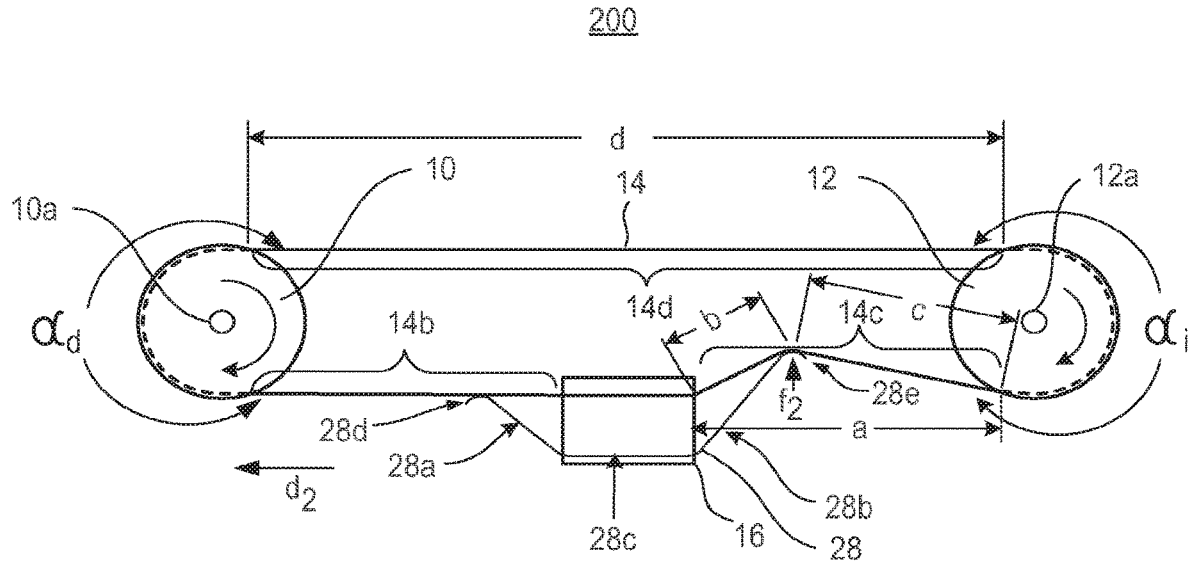
FIG. 3B is a schematic view illustrating the drive belt system of FIG. 2 in which the belt is moving in a second direction according to an example.

FIG. 2 is a block diagram illustrating a drive belt system according to an example. FIGS. 3A and 3B are schematic views illustrating the drive belt system of FIG. 2 in which a belt is moving in a first direction (FIG. 3A) and a second direction (FIG. 3B), respectively, according to examples. Referring to FIG. 2, in some examples, a drive belt system 200 includes a drive pulley member 10 having a drive axis 10*a*, an idler pulley member 12 having an idler axis 12*a*, a belt 14, a transport unit 16, and a belt stretch management apparatus 28.

Figure 6:
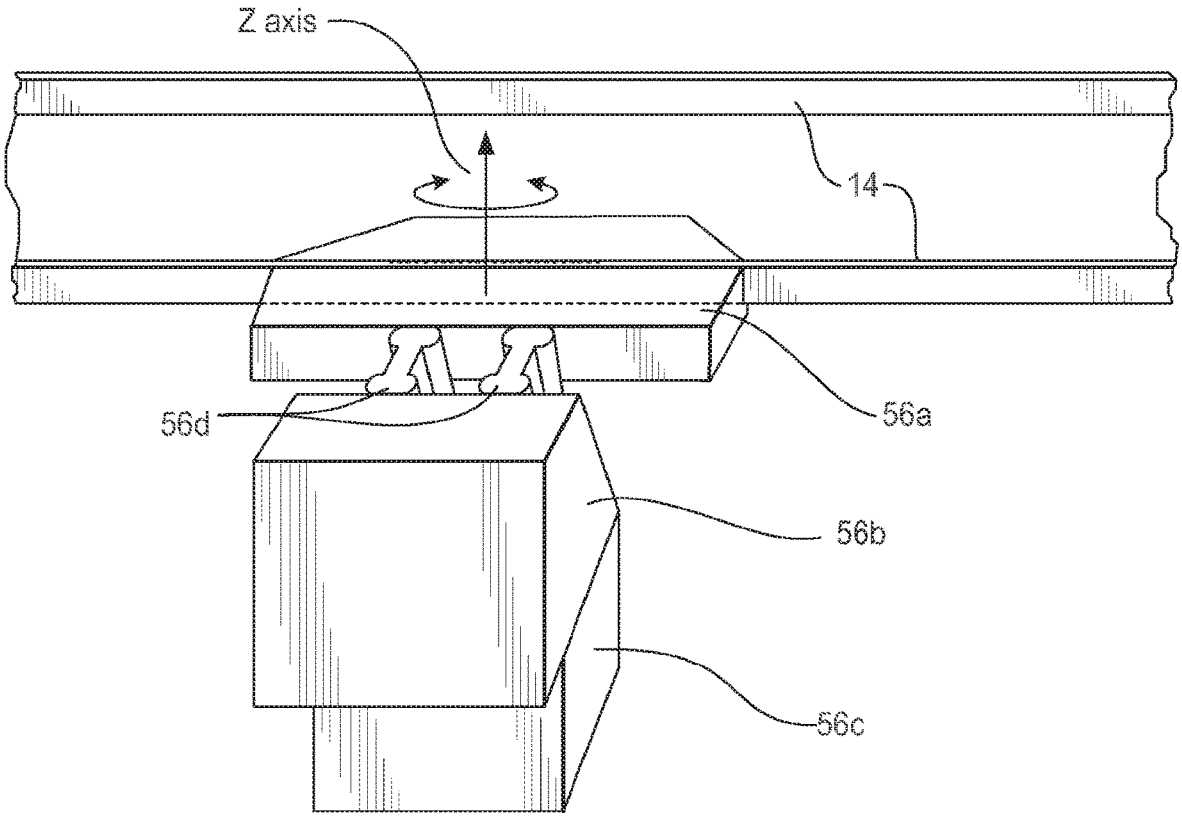
FIG. 6 is a perspective view illustrating a reciprocating carriage unit of the drive belt system of FIG. 5 according to an example.

Referring to FIGS. 3A and 3B, in some examples, the drive pulley member 10 rotates about the drive axis 10*a* thereof. The idler pulley member 12 rotates about the idler axis 12*a* thereof. The belt 14 forms a continuous loop and moves about the drive pulley member 10 and the idler pulley member 12 in response to rotation by the drive pulley member 10. For example, a drive motor (not illustrated) may be connected to the drive pulley member 10 to rotate the drive pulley member 10 about the drive axis 10*a*. The transport unit 16 may be transported in a first direction $d_1$ away from the drive pulley member 10 as illustrated in FIG. 3A and in a second direction $d_2$ towards the drive pulley member 10 as illustrated in FIG. 3B. The transport unit 16 is coupled to and transported by the belt 14. In some examples, the transport unit 16 may include a reciprocating carriage unit 56 (FIG. 6).

Referring to FIG. 3A, the belt stretch management apparatus 28 is coupled to and moves with the transport unit 16. The belt stretch management apparatus 28 applies at least one force to the belt 14 in a transverse direction thereto to direct a portion of the belt 14 about at least one of the drive pulley member 10 and the idler pulley member 12 in response to a formation of belt stretch to the belt 14. For example, the belt stretch management apparatus 28 may manage belt stretch (e.g., an effective increase to a length of the belt 14 by an application of forces and/or a reduction of distance between the drive pulley member 10 and the idler pulley member 12) by applying at least a first force $f_1$ to the belt 14 to direct a portion of the belt 14 about the drive pulley member 10. That is, a formation of belt stretch to the drive-side belt portion 14*b* is managed by further wrapping a portion of the drive-side belt portion 14*b* about the drive pulley member 10. Thus, the potential for the wrap angle $\alpha_d$ about the drive pulley member 10 to decrease due to the belt stretch and the drive belt system 200 to enter a slack state is reduced.

Referring to FIG. 3B, in some examples, the belt stretch management apparatus 28 may also manage belt stretch by applying at least a second force $f_2$ to the belt 14 to direct a portion of an idler-side belt portion 14*c* (e.g., portion of the belt 14 disposed between the transport unit 16 and the idler pulley member 12) about the idler pulley member 12 in response to the formation of belt stretch due to the transportation of the transport unit 16 in the second direction $d_2$. That is, a formation of belt stretch to the idler-side belt portion 14*c* is managed by further wrapping a portion of the idler-side belt portion 14*c* about the idler pulley member 12.

Additionally, in some examples, adequate use of increased belt length due to belt stretch by the second arm member 28*b* of the belt stretch management apparatus 26 results in the respective wrap angle $\alpha_d$ about the drive puller member 10 before and after the formation of belt stretch being approximately equal. For example, in some examples, belt stretch may correspond to an increase amount of belt length corresponding to a length b plus a length c minus a length a. Due to adequate use of the belt stretch by the belt stretch management apparatus 58, a length of the extended belt portion 14*d* (e.g., a portion of the belt 14 disposed opposite the transport unit 16 and between the drive pulley member 10 and the idler pulley member 12) may remain the same (e.g. length d) before and after the formation of belt stretch.

In some examples, the forces $f_1$ and $f_2$ applied to the belt 14 by the belt stretch management apparatus 28 may be minimal. Such minimal forces $f_1$ and $f_2$ may be to direct the respective portions of the belt 14 about the respective pulley members 10 and 12 and not to provide primary tension forces to the belt 14 which are generally provided by the setting of the respective pulley members 10 and 12. Accordingly, in some examples, the minimal forces $f_1$ and $f_2$ applied by the belt stretch management apparatus 28 may offset the periodic formation of belt stretch.

Referring to FIG. 3A, in some examples, the belt stretch management apparatus 28 includes a first arm member 28*a*, a second arm member 28*b* and a middle member 28*c*. The middle member 28*c* is coupled to the transport unit 16 such that the middle member 28*c* is disposed between and connected to the first arm member 28*a* and the second arm member 28*b*. The first arm member 28*a* extends from the transport unit 16 to a drive-side belt portion 14*b* disposed between the transport unit 16 and the drive pulley member 10. The first arm member 28*a* is in contact with the drive-side belt portion 14*b*.

The first arm member 28*a* may apply the first force $f_1$ approximately perpendicular (e.g., an angle in a range from about eighty to about one hundred degrees) to the drive-side belt portion 14*b* that it contacts to direct a portion of the drive-side belt portion 14*b* about the drive pulley member 10 in response to the formation of belt stretch to the belt 14 due to transportation of the transport unit 16 in the first direction $d_1$. The first arm member 28*a* reduces the potential of the wrap angle $\alpha_d$ about the drive pulley member 10 to decrease due to belt stretch by maintaining or increasing an amount of the respective wrap angle $\alpha_d$ that existed prior to the formation of belt stretch. Thus, the potential for the drive belt system 200 to enter a slack state is reduced.

Referring to FIG. 3A, in some examples, the second arm member 28*b* extends from the transport unit 16 to an idler-side belt portion 14*c* disposed between the transport unit 16 and the idler pulley member 12. The second arm member 28*b* is in contact with the idler-side belt portion 14*c*. The second arm member 28*b* may apply the second force $f_2$ approximately perpendicular (e.g., at an angle in a range from about eighty to about one hundred degrees) to the idler-side belt portion 14*c* that it contacts to direct a portion of the idler-side belt portion 14*c* about the idler pulley member 12. For example, the second arm member 28*b* may direct the portion of the idler-side belt portion 14*c* about the idler pulley member 12 in response to a formation of belt stretch to the idler-side portion 14*c* due to transportation of the transport unit 16 in the second direction $d_2$.

Referring to FIG. 3B, the second arm member 28*b* reduces the potential of the wrap angle $\alpha_i$ about the idler pulley member 12 to decrease due to belt stretch by maintaining or increasing an amount of the respective wrap angle $\alpha_i$ that existed prior to the formation of belt stretch. Additionally, in some examples, the maintaining of the respective wrap angle $\alpha_d$ about the drive puller member 10 before and after formation of belt stretch approximately equal keeps the amount of wrap of the belt 14 about the drive pulley member 10 approximately unchanged. Thus, the potential for the drive belt system 200 to enter a slack state is reduced.

Figure 4:
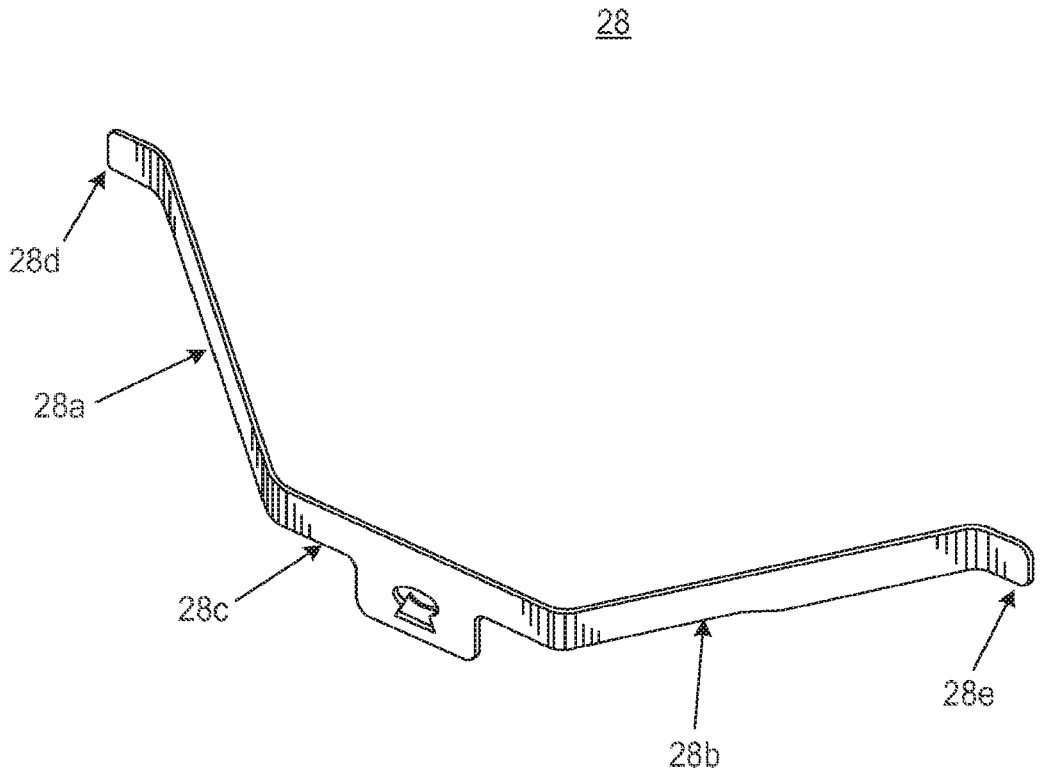
FIG. 4 is a perspective view illustrating a belt stretch management apparatus of the drive belt system of FIG. 2 in an uninstalled state according to an example.

FIG. 4 is a perspective view illustrating the belt stretch management apparatus of the drive belt system of FIG. 2 in an uninstalled state according to an example. As illustrated in FIG. 4, in an uninstalled state, the belt stretch management apparatus 28 is not coupled to the transport unit 16 and does not engage the belt 14. As illustrated in FIGS. 3A and 3B, in an installed state, the belt stretch management apparatus 28 is coupled to the transport unit 16 and engages the belt 14. Referring to FIG. 4, in some examples, the belt stretch management apparatus 28 is a unitary spring member, for example, formed of sheet metal. In some examples, the belt stretch management apparatus 28 may be in a form of a multi-piece apparatus. The belt stretch management apparatus 28 may include a first arm member 28*a*, a second arm member 28*b* and a middle member 28*c*. The middle member 28*c* is disposed between and connected to the first arm member 28*a* and the second arm member 28*b*. The middle member 28*c* forms an angle with each one of the first arm member 28*a* and the second arm member 28*b*.

As illustrated in FIGS. 3A and 3B, in the installed state, the middle member may be coupled to the transport unit 16, the first arm member 28*a* may extend from the transport unit 16 to a drive-side belt portion 14*b* disposed between the transport unit 16 and the drive pulley member 10, and the second arm member 28*b* may extend from the transport unit 16 to an idler-side belt portion 14*c* disposed between the transport unit 16 and the idler pulley member 12. Also, in the installed state, the first arm member 28*a* may contact the drive-side belt portion 14*b* to apply the first force $f_1$ in an approximately perpendicular direction thereto and the second arm member 28*b* may contact the idler-side belt portion 14*c* to apply the second force $f_2$ in an approximately perpendicular direction thereto.

The first arm member 28*a* may include a first end arm portion 28*d* to contact the belt 14 and the second arm member 28*b* may include a second end arm portion 28*e* to contact the belt 14. The first end arm portion 28*d* may form an angle with an other portion of the first arm member 28*a* and the second end arm portion 28*e* may form an angle with an other portion of the second arm member 28*b*. For example, the first end arm portion 28*d* and the second end arm portion 28*e* may provide a smooth rounded surface for the belt 14 against which to move. In some examples, the first end arm portion 28*d* and the second end arm portion 28*e* may include a roller (not illustrated).

Figure 5:
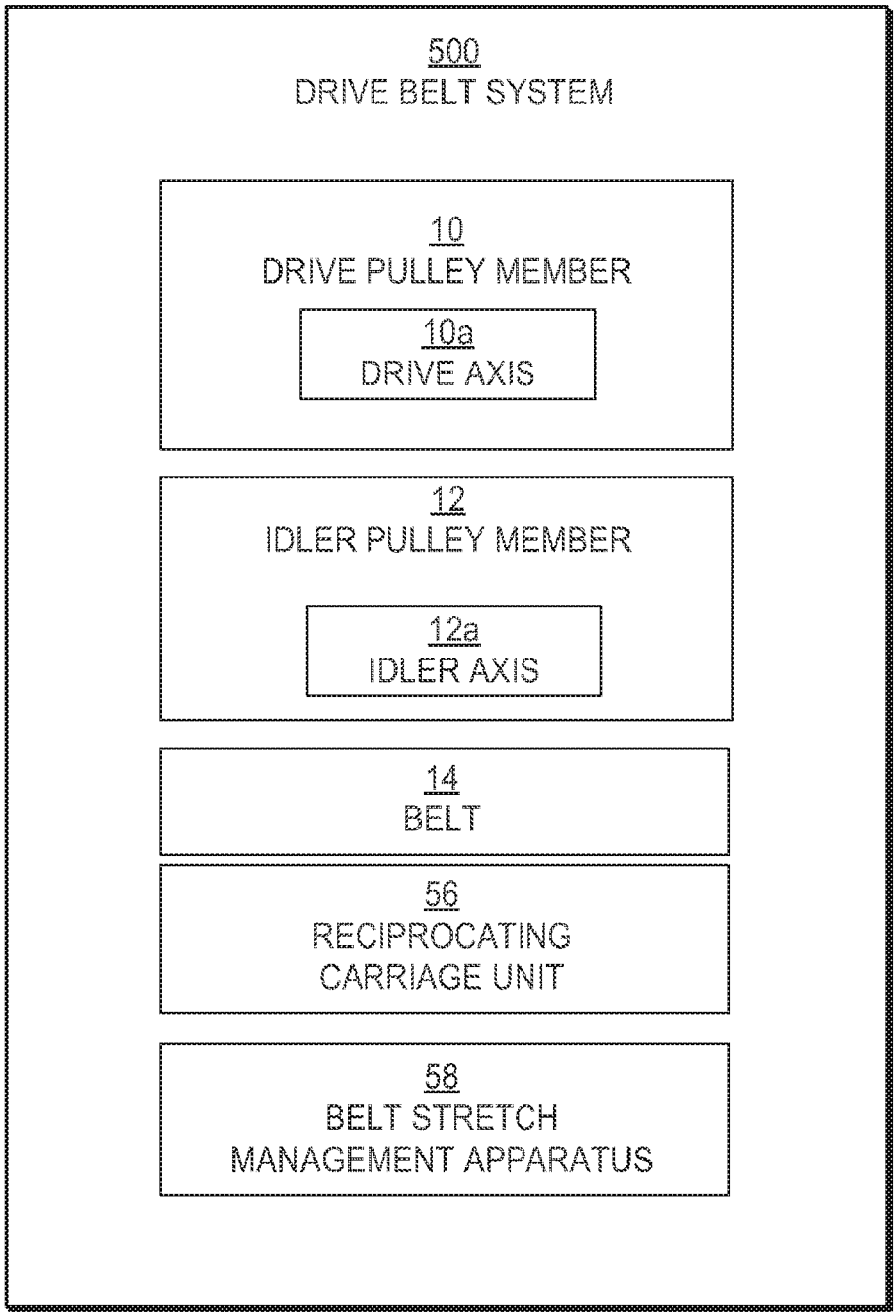
FIG. 5 is a block diagram illustrating a drive belt system usable with an image forming apparatus according to an example.

FIG. 5 is a block diagram illustrating a drive belt system usable with an image forming apparatus according to an example. Referring to FIG. 5, in some examples, a drive belt system 500 includes a drive pulley member 10 having a drive axis 10*a*, an idler pulley member 12 having an idler axis 12*a*, a belt 14, a reciprocating carriage unit 56, and a belt stretch management apparatus 58. The drive belt system 500 may be usable with an image forming apparatus (not illustrated).

FIG. 6 is a perspective view illustrating a reciprocating carriage unit of the drive belt system of FIG. 5 according to an example. Referring to FIG. 6. For purposes of clarity of illustration only, the belt stretch maintenance apparatus 58 is not illustrated in FIG. 6. Referring to FIG. 6, in some examples, a reciprocating carriage unit 56 may removably receive a printhead 56*c* in a loaded state. The reciprocating carriage unit 56 may also include at least one removable ink supply container (not illustrated) to supply ink to the printhead 56*c*. The printhead 56*c* may be disposed in the reciprocating carriage unit 56 in a loaded state thereof to selectively eject ink onto media to form images thereon. In some examples, the reciprocating carriage unit 56 may include at least one of a coupling member 56*a*, compliant isolator members 56*d*, a carriage member 56*b*, and a printhead 56*c*. The carriage member 56*b* may removably receive the printhead 56*c*. The coupling unit 56*a* may couple the carriage member 56*b* to the belt 14. The compliant isolator members 56*d*, for example, may be mounted between the coupling member 56*a* and the carriage member 56*b* to reduce or filter vibrations from being passed, for example, from the drive motor to the carriage member 56*b* via the belt 14.

Figure 7:
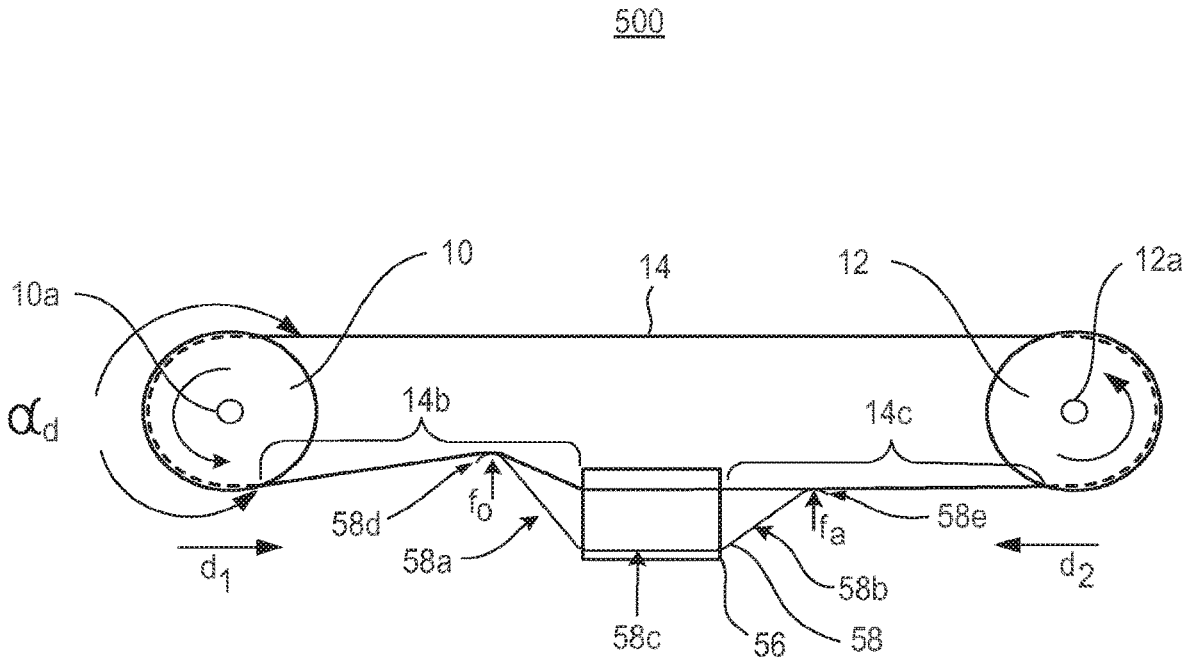
FIG. 7 is a schematic view illustrating the drive belt system of FIG. 5 in which a belt is moving in a first direction according to an example.

Referring to FIGS. 6 and 7, the z-axis represents an axis about which the coupling member 56*a* may tend to rotate, for example, in response to a first arm member 58*a* applying the one force $f_o$ against the drive-side belt portion 14*b* and absent an application of the other force $f_a$ (e.g., stabilizing force) to the idler-side belt portion 14*c* by a second arm member 58*b* as illustrated in FIG. 6. The printhead 56*c* may be removably held in the carriage member 56*b*. In some examples, the carriage member 56*b* may include a plurality of printheads disposed in the carriage member 56*b*. In some examples, the belt 14 may be directly coupled to the carriage member 56*b*. The reciprocating carriage unit 56 may slide on and be guided by surfaces such as sheet metal, cylindrical rods, and the like.

FIG. 7 is a schematic view illustrating the drive belt system of FIG. 5 in which a belt is moving in a first direction according to an example. Referring to FIGS. 5 and 7, in some examples, the drive pulley member 10 rotates about the drive axis 10*a* thereof. The idler pulley member 12 rotates about the idler axis 12*a* thereof. The belt 14 forms a continuous loop and moves about the drive pulley member 10 and the idler pulley member 12 in response to rotation by the drive pulley member 10. For example, a drive motor (not illustrated) may be connected to the drive pulley member 10 to rotate the drive pulley member 10 about the drive axis 10*a*. The reciprocating carriage unit 56 is coupled to and is transported by the belt 14 in a first direction $d_1$ away from the drive pulley member 10 and in a second direction $d_2$ toward the drive pulley member 10. The reciprocating carriage unit 56 may removably receive a printhead 56*c*. The reciprocating carriage unit 56 or the printhead 56*c* may removably receive ink supply containers (not illustrated). Accordingly, the printhead 56*c* may be disposed in the reciprocating carriage unit 56 in a loaded state thereof to selectively eject ink onto media to form images thereon.

Referring to FIGS. 5 and 7, the belt stretch management apparatus 58 may be coupled to the reciprocating carriage unit 56. The belt stretch management apparatus 58 may apply at least one force $f_o$ to the belt 14 in a traverse direction thereto to direct a portion of the drive-side belt portion 14*b* (e.g., portion of the belt 14 between the reciprocating carriage unit 16 and the drive pulley member 10) about the drive pulley member 10 in response to a formation of belt stretch to the belt 14 due to transportation of the reciprocating carriage unit 56 along with the belt stretch management apparatus 58 in the first direction $d_1$.

For example, the belt stretch management apparatus 58 may manage belt stretch by applying at least one force $f_o$ to the belt 14 to direct a portion of the drive-side belt portion 14*b* about the drive pulley member 10. That is, a formation of belt stretch to the drive-side belt portion 14*b* is managed by further wrapping the portion of the drive-side belt portion 14*b* about the drive pulley member 10. Thus, the potential of the wrap angle $\alpha_d$ about the drive pulley member 10 to decrease due to belt stretch and the drive belt system 500 to enter a slack state is reduced by maintaining or increasing an amount of the respective wrap angle $\alpha_d$ that existed prior to the formation of belt stretch.

Referring to FIG. 7, in some examples, the belt stretch management apparatus 58 may include a first arm member 58*a*, a second arm member 58*b* and a middle member 58*c*. In an uninstalled state, the belt stretch management apparatus 58 is not coupled to the reciprocating carriage unit 56 and does not engage the belt 14. As illustrated in FIG. 6, in an installed state, the belt stretch management apparatus 58 is coupled to the reciprocating carriage unit 56 and engages the belt 14. The middle member 58*c* may be disposed between and connected to the first arm member 58*a* and the second arm member 58*b*. The middle member 58*c* may form an angle with each one of the first arm member 58*a* and the second arm member 58*b*.

Referring to FIG. 7, in the installed state, the middle member 58*c* may be coupled to the reciprocating carriage unit. 58*c*, the first arm member 58*a* may extend from the reciprocating carriage unit 56 to the drive-side belt portion 14*b* disposed between the reciprocating carriage unit 56 and the drive pulley member 10, and the second arm member 58*b* may extend from the reciprocating carriage unit 56 to an idler-side belt portion 14*c* disposed between the reciprocating carriage unit 56 and the idler pulley member 12. Also, the first arm member 58*a* may contact the drive-side belt portion 14*b* and the second arm member 58*b* may contact the idler-side portion 14*c*.

In the installed state, the first arm member 58*a* may apply the at least one force $f_o$ to the drive-side belt portion 14*b* that it contacts in an approximately perpendicular direction (e.g., an angle in a range from about eighty to about one hundred degrees) thereto to direct a portion of the drive-side belt portion 14*b* about the drive pulley member 10. The first arm member may direct the portion of the drive-side belt portion 14*b* about the drive pulley member 10 in response a formation of belt stretch to the drive-side belt portion 14*b* due to transportation of the reciprocating carriage unit 56 along with the belt stretch management apparatus 58 in the first direction $f_1$.

The potential of the wrap angle $\alpha_d$ about the drive pulley member 10 to decrease due to belt stretch and the drive belt system 500 to enter a slack state is reduced by maintaining or increasing an amount of the respective wrap angle $\alpha_d$ that existed prior to the formation of belt stretch. In the installed state, the second arm member 58*b* may apply at least an other force $f_a$ onto the idler-side belt portion 14*c*. The at least other force $f_a$ may act as a stabilizing force to counter balance the application of the one force $f_o$ with respect to the reciprocating carriage unit 56 to minimize a net torque from the belt stretch management apparatus 58.

That is, a coupling member 56*a*, for example, coupled to compliant isolator members 56*d* may be susceptible to rotation about a z-axis (FIG. 6) due to the first arm member 28*a* being in contact with and applying the one force $f_o$ to the drive-side belt portion 14*b* that it contacts, The other force $f_a$ counter balances the rotational tendency of the coupling member 56*a*. Accordingly, the at least other force $f_a$ may reduce rotation of the coupling member 56*a* of the reciprocating carriage unit 56 in a loaded state thereof, for example, when the one force $f_o$ is applied by the first arm member 58*a*. In some examples, the belt stretch management apparatus 58 may be a unitary spring member, for example, formed of sheet metal.

Figure 8:
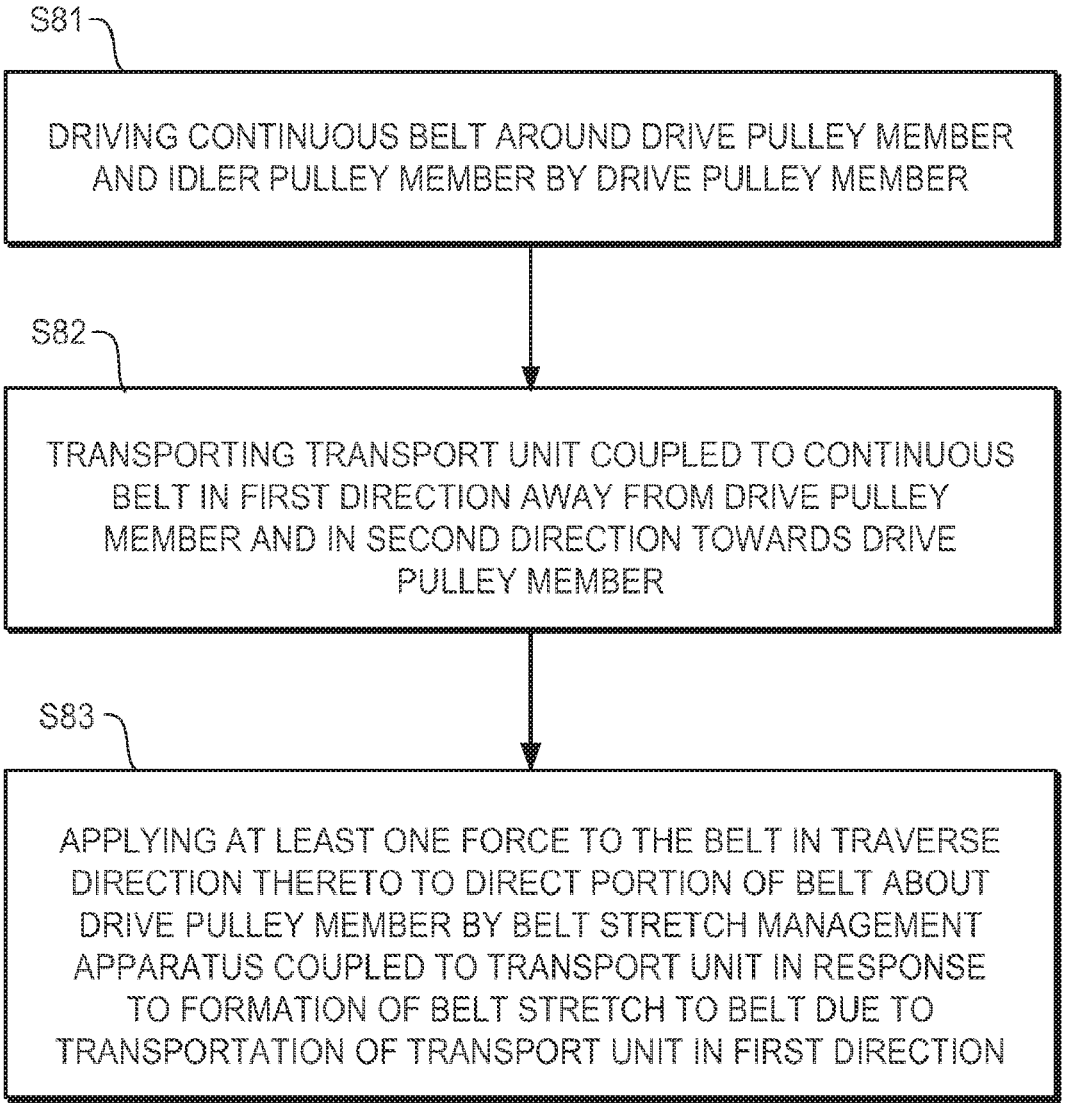
FIG. 8 is a flowchart illustrating a method of managing belt stretch in a drive belt system according to an example.

FIG. 8 is a flowchart illustrating a method of managing belt stretch in a drive belt system according to an example. Referring to FIG. 8, in block S81, a continuous belt is driven around a drive pulley member and an idler pulley member by the drive pulley member. For example, a drive motor (not illustrated) may be connected to the drive pulley member to rotate the drive pulley member about the drive axis. In block S82, a transport unit coupled to the continuous belt is transported in a first direction away from the drive pulley member and in a second direction towards the drive pulley member. In some examples, the transport unit may include a reciprocating carriage unit to removably receive at least one printhead, for example, as previously disclosed with respect to FIG. 6.

In block S83, at least one force is applied to the belt in a traverse direction thereto to direct a portion of the belt about the drive pulley member by a belt stretch management apparatus coupled to the transport unit in response to a formation of belt stretch to the belt due to transportation of the transport unit in the first direction. For example, a formation of belt stretch to the drive-side belt portion is managed by further wrapping a portion of the drive-side belt portion about the drive pulley member. In some examples, the method also includes applying at least an other force to the belt in a traverse direction thereto to reduce rotation of the transport unit or a portion thereof. The belt stretch management apparatus may include a unitary spring member, for example, formed of sheet metal as previously disclosed with respect to FIG. 4.

It is to be understood that the flowchart of FIG. 8 illustrates an architecture, functionality, and operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 8 illustrates a specific order of execution, the order of execution may differ from that which is depicted. For example, the order of execution of two or more blocks may be scrambled relative to the order illustrated. Also, two or more blocks illustrated in succession in FIG. 8 may be executed concurrently or with partial concurrence. All such variations are within the scope of the present disclosure.

The present disclosure has been described using non-limiting detailed descriptions of examples thereof that are not intended to limit the scope of the present disclosure. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the present disclosure and which are described for illustrative purposes. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A method of managing belt stretch in a drive belt system, the method comprising:

driving a continuous belt around a drive pulley member and an idler pulley member by the drive pulley member;

transporting a transport unit coupled to the belt in a first direction away from the drive pulley member and in a second direction towards the drive pulley member; and applying at least one force to the belt in a traverse direction thereto to direct a portion of the belt about at least one of the drive pulley member and the idler pulley member, including applying the at least one force by a first arm member extending from the transport unit to the belt at a first angle and a second arm member extending from the transport unit to the belt at a second angle.

2. The method according to claim 1, comprising:

a middle member coupled to the transport unit such that the first arm member extends from the middle member in a direction including the first direction and the second arm member extends from the middle member in a direction including the second direction.

3. The method according to claim 1, comprising:

the first arm member extending from the transport unit to a drive-side belt portion disposed between the transport unit and the drive pulley member, the first arm member in contact with the drive-side belt portion to apply the at least one force to the belt in an approximately perpendicular direction to a length of the belt; and the second arm member extending from the transport unit to an idler-side belt portion disposed between the transport unit and the idler pulley member, the second arm member in contact with the idler-side belt portion to apply at least another force to the belt in an approximately perpendicular direction to a length of the belt.

4. The method according to claim 1, wherein the first arm member and the second arm member comprise a unitary spring member formed of sheet metal, the unitary spring member having a first end portion and a second end portion each contacting the belt.

5. The method according to claim 1, wherein the transport unit comprises a reciprocating carriage unit to removably receive at least one printhead.

6. A drive belt system usable with an image forming system, the drive belt system comprising:

a drive pulley member having a drive axis to rotate thereabout;

an idler pulley member having an idler axis to rotate thereabout;

a belt to form a continuous loop and to move about the drive pulley member and the idler pulley member in response to rotation by the drive pulley member;

a reciprocating carriage unit coupled to and to be transported by the belt in a first direction away from the drive pulley member and in a second direction toward the drive pulley member, the reciprocating carriage unit to removably receive at least one printhead; and a first arm member extending from the reciprocating carriage unit to the belt in a direction including the first direction and a second arm member extending from the reciprocating carriage unit to the belt in a direction including the second direction, the first arm member and the second arm member to apply at least one force to the belt in a traverse direction thereto to direct a portion of the belt about at least one of the drive pulley member and the idler pulley member.

7. The drive belt system according to claim 6, comprising:

the first arm member extending from the reciprocating carriage unit to a drive-side belt portion disposed between the reciprocating carriage unit and the drive pulley member, the first arm member in contact with the drive-side belt portion such that the first arm member applies the at least one force to the drive-side belt portion in an approximately perpendicular direction to a longitudinal axis of the belt.

8. The drive belt system according to claim 6, comprising:

the first arm member extending from the reciprocating carriage unit to the belt at a first angle and the second arm member extending from the reciprocating carriage unit to the belt at a second angle.

9. The drive belt system according to claim 6, comprising:

the second arm member extending from the reciprocating carriage unit to an idler-side belt portion disposed between the reciprocating carriage unit and the idler pulley member, the second arm member in contact with the idler-side belt portion such that the second arm member applies the at least one force to the idler-side belt portion in an approximately perpendicular direction to a longitudinal axis of the belt.

10. The drive belt system according to claim 6, further comprising:

a middle member coupled to the reciprocating carriage unit such that the first arm member extends from a first end of the middle member and the second arm member extends from a second end of the middle member.

11. The drive belt system according to claim 6, wherein the first arm member and the second arm member comprise a unitary spring member formed of sheet metal, the unitary spring member having a first end portion and a second end portion each contacting the belt.

12. A drive belt system, comprising:

a drive pulley member having a drive axis to rotate thereabout;

an idler pulley member having an idler axis to rotate thereabout;

a belt to form a continuous loop and to move about the drive pulley member and the idler pulley member in response to rotation by the drive pulley member;

a transport unit coupled to and to be transported by the belt; and a first arm member extending from the transport unit to the belt at a first angle and a second arm member extending from the transport unit to the belt at a second angle, the first angle and the second angle each including an angular component extending along a length of a portion of the belt, and the first arm member and the second arm member to apply at least one force to the belt in a transverse direction thereto to direct a portion of the belt about at least one of the drive pulley member and the idler pulley member in response to a formation of belt stretch to the belt.

13. The drive belt system according to claim 12, wherein the transport unit is to be transported in a first direction away from the drive pulley member and in a second direction towards the drive pulley member.

14. The drive belt system according to claim 13, wherein the first arm member extends from the transport unit to a drive-side belt portion disposed between the transport unit and the drive pulley member such that the first arm member is in contact with the drive-side belt portion; and wherein the first arm member applies a first force approximately perpendicular to the drive-side belt portion to direct a portion of the drive-side belt portion about the drive pulley member in response to the formation of belt stretch to the belt due to transportation of the transport unit in the first direction.

15. The drive belt system according to claim 13, wherein the first arm member extends from the transport unit to the belt in a direction including the first direction and the second arm member extends from the transport unit to the belt in a direction including the second direction.

16. The drive belt system according to claim 13, wherein the second arm member extends from the transport unit to an idler-side belt portion disposed between the transport unit and the idler pulley member such that the second arm member is in contact with the idler-side belt portion; and wherein the second arm member applies a second force approximately perpendicular to the idler-side belt portion to direct a portion of the idler-side belt portion about the idler pulley member in response to the formation of belt stretch to the belt due to transportation of the transport unit in the second direction.

17. The drive belt system according to claim 12, further comprising:

a middle member coupled to the transport unit such that the first arm member extends from a first end of the middle member in a first direction and the second arm member extends from a second end of the middle member in a second direction.

18. The drive belt system according to claim 12, wherein the first arm member and the second arm member comprise a unitary spring member formed of sheet metal, the unitary spring member having a first end portion and a second end portion each contacting the belt.

19. The drive belt system according to claim 12, wherein the transport unit comprises a reciprocating carriage unit to removably receive at least one printhead.

20. The drive belt system according to claim 19, wherein the reciprocating carriage unit further comprises:

a carriage member to receive the at least one printhead;

a coupling member to couple the carriage member to the belt; and at least one compliant isolator member coupling the coupling member to the carriage member.

* * * * *